US005950322A

United States Patent [19]

Knabe

[11] Patent Number: 5,950,322

[45] Date of Patent: Sep. 14, 1999

[54] DRIER WITH EXHAUST GAS PURIFICATION

[75] Inventor: Martin Knabe, Sengenthal, Germany

[73] Assignee: Firma Starcosa-Tag, Division of Braunschweigische Maschinenbauanstalt AG, Braunschweig, Germany

[21] Appl. No.: 08/994,074

[22] Filed: Dec. 19, 1997

[30] Foreign Application Priority Data

Dec. 23, 1996 [DE] Germany ..... 196 54 043

[51] Int. Cl.[6] ..... F26B 19/00

[52] U.S. Cl. ..... 34/86; 34/219; 34/78

[58] Field of Search ..... 34/418, 426, 514, 34/68, 77, 78, 79, 86, 130, 131, 132, 134, 138; 110/224, 226, 246; 432/105, 107

[56] References Cited

U.S. PATENT DOCUMENTS

| | | | |
|---|---|---|---|
| 5,237,757 | 8/1993 | Wiedmann et al. | 34/513 |
| 5,271,162 | 12/1993 | Kunz et al. | 34/493 |
| 5,697,167 | 12/1997 | Kunz et al. | 34/86 |

FOREIGN PATENT DOCUMENTS 40 17 806 12/1991 Germany .

OTHER PUBLICATIONS

Article from "Swiss Combi News" entitled "ecoDry und ecoTwin" by W. Kunz AG of Switzerland, four pages, Sep. 1994.

*Primary Examiner*—Henry Bennett
*Assistant Examiner*—Pamela A. Wilson
*Attorney, Agent, or Firm*—Cohen, Pontani, Lieberman & Pavane

[57] ABSTRACT

A drier for wood chips and other bulk materials includes an incinerator for indirectly heating a drying apparatus. The drier operates in a circulatory gas operation with a high water vapor load. All drier exhaust gases are fed to the incinerator and thermally post-combusted there. The drying apparatus includes two drier lines. The first line is heated with the heat of the inflowing vapor, the heat being removed from the exhaust gas flow in a gas-gas heat exchanger and supplied to the vapor feedback. The second drier line includes a heat register, whose heat is extracted from the exhaust gases in a heater, which is arranged directly after the incinerator and reduces the exhaust gas temperature to approximately 500° to 600°. The gas-gas heat exchanger can thus be embodied as a simple sheet metal structure.

10 Claims, 1 Drawing Sheet

DRIER WITH EXHAUST GAS PURIFICATION

BACKGROUND OF THE INVENTION

1. Field of the Invention

The invention relates to a drier with exhaust gas purification by means of thermal post-combustion for water-damp bulk materials, such as wood chips, green forage and similar organic particles. The dried exhaust gases are purified of organic toxic and odorous substances and also of combustible fine dust by means of thermal post-combustion in the incinerator of the drier.

2. Discussion of the Prior Art

Such a drier operates in a known manner with a vapor feedback line for feeding a portion of the vapor that comes from the drier back to the entrance side of the drying apparatus. The drier thus has a vapor circuit. A surplus amount of vapor, which results from evaporation by the drier as well as from any air that might flow into the vapor circuit from the outside, is removed from the vapor circuit. The drier has its own incinerator, which comprises a combustion chamber with at least one burner for the incineration of gas, oil or combustion dust. The removed vapor flow is supplied to the incinerator as secondary air and is thereby heated to at least c. 800° C. to 850° C., so that the organic toxic and odorous substances contained in the flow are burned to the greatest extent possible.

The drier is not heated directly by the supply of hot incinerator exhaust gases to the drying apparatus. Rather, heat is extracted from the incinerator exhaust gases in a gas-gas heat exchanger and fed to the vapor circuit.

Finally, another heat exchanger is usually arranged in the flow of the incinerator waste gases to serve as an air preheater for the fresh air flowing to the drier, e.g., the combustion air. As a result, the combustion exhaust gases are further cooled before either being supplied to a downstream purification step, e.g., for further dust removal, or released directly into the free air through a exhaust gas chimney.

Drier units of this type are known, for example, from German reference DE OS 40 17 806 and from the product description in "swiss combi news" 1/94 of W. Kunz dryTec AG, CH 5606 Dintikon, Switzerland. Such drier units supply vapor from the drier to the incinerator to bum organic materials, and then feed the incinerator gases through a heat exchanger. The incinerator gases thereby heat the vapor circuit, and thus supply the drier with heat needed to evaporate the water contained in the material being dried. However, known units of this type have the disadvantage that the incinerator gases enter the gas-gas heat exchanger on the heat side at combustion chamber temperature, whereas a temperature of approximately 800° C. to 850° C. is needed to ensure reliable thermal destruction of the toxic and odorous substances. Experience has shown that when the combustion chamber temperature is low, sufficient thermal destruction of the organic toxic and odorous substances does not occur. Moreover, the sulfuric and other substances contained in fine dust and first released in the combustion chamber are insufficiently burned as a result of excessively low temperatures. Indeed, the total amount of toxic and odorous substances can even increase in a combustion chamber given an excessively low temperature.

In previously known driers of this type, the gas-gas heat exchanger alone transfers the total drying heat from the incinerator exhaust gas to the vapor circuit of the drier.

Because of the high heat-side temperature load, it is disadvantageously necessary to use massive structures with heat-resistant steels and refractory-grade materials for the heat exchanger, which therefore becomes very large and expensive. It is also disadvantageous that, due to the massive structure required for the heat exchanger, the heat storage mass of the heat exchanger is very high. The control behavior of the drier during operational fluctuations is therefore sluggish. It is also disadvantageous that the gas-gas heat exchanger, given its massive structure and the poor conductivity of its refractory-grade materials compared with sheet metal, has a higher temperature differential from the entrance heat side to the exit cool side and from the entrance cool side to the exit heat side than do exchangers made of sheet metal. Moreover, it is disadvantageous that the gas-gas heat exchanger (which cannot be operated with direct current, because then the heat-side exit temperature would necessarily exceed the cool-side exit temperature), permits maximum temperatures at the cool side exit of only 400° C. to 500° C., so as to avoid damaging the wall between the heat side and the cool side by the temperature load placed upon it. For this reason and because of the poor heat transfer, the gas-gas heat exchanger disadvantageously operates with lower efficiency than sheet metal embodiments. The exit temperature on the heat side is therefore so high that, despite a downstream air pre-heater for inflowing fresh air, the exhaust air temperature at the chimney is still approximately 180° C. This far exceeds the exhaust gas temperatures of 120° C. to 130° C. that are known from directly heated driers for the same bulk materials. It is also disadvantageous that the combustion chamber temperature, which, because of the limited temperature load capacity of the heat exchanger, cannot exceed the required minimum of roughly 800° C. to, at the most, 850° C., is subject to downward fluctuations during operation, resulting in states of reduced toxic substance combustion. Disadvantageously, the exhaust air temperature, which still equals 180° C. after the fresh air preheater, can no longer be used for the drying process. Therefore, this heat, if it is to be used, must be supplied to other users, which is known to be expensive and often is not possible. It is true that arrangements are known, such as that described in the product description "swiss combi news" 1/94 of the W. Kunz dryTec AG, CH 5606, Dintikon, in which the exhaust gases of the drier serve for the direct heating of a pre-drier. Markedly lower exhaust air temperatures are achieved in this case. Disadvantageously, however, not all of the vapor from the pre-drier is fed to the incinerator; thus, some is emitted, along with the toxic and odorous substances contained therein and released in the pre-drier, via the exhaust air without thermal post-combustion.

Accordingly, it is an object of the present invention to provide a drier which, while maintaining at least the same drier efficiency, allows the gas-gas heat exchanger to be designed much more simply and economically, and permits incineration temperatures high enough to reliably bum the toxic and odorous substances contained in the vapors fed to the incinerator, whereby all vapors are fed to the incinerator, and the drier exhaust air temperature can be kept clearly lower than in previously described systems of this type.

Pursuant to this object, and others which will become apparent hereafter, one aspect of the present invention resides in a drier, with a drying apparatus preferably embodied as a rotary drum, having its own incinerator to produce the required drying heat. However, the hot exhaust gases from the incinerator are not fed directly to the drying apparatus for heating purposes. The drier operates in the known manner with vapor feedback, so that the drying apparatus and the feedback for vapors to the drier entrance are part of a vapor circuit. In the vapor circuit, heat is supplied-by means of a gas-gas heat exchanger that removes heat from the incinerator exhaust gases-to the fed-back portion of the vapor flow, which has emerged from the drying apparatus and was cooled during drying, before this fed-back portion of the vapor flow reenters the drying apparatus. Reheated in this manner, the fed-back vapor flow supplies drying heat as a drying medium to the drying apparatus. An excess partial flow that results from evaporation in the drying apparatus and, as applicable, from air flowing into the vapor circuit, is removed from the vapor circuit and fed as secondary air to the incinerator, where the toxic and odorous substances contained in the removed partial flow are burned at the prevailing temperatures. Usually, an air preheater is arranged in the flow of the incineration exhaust gases after the gas-gas heat exchanger. After the incinerator exhaust gases have passed through the gas-gas heat exchanger for the purpose of heating the vapor, the air preheater extracts additional heat from these gases and transmits the heat to fresh air that is supplied to the drier.

According to the invention, an additional heat transfer device is arranged in the flow of the incinerator exhaust gases in front of the gas-gas heat exchanger. The incinerator gases, which enter at combustion chamber temperature on the heat side, flow through the additional heat transfer device. The incinerator gases are thereby cooled, and either produce steam on the cool side or heat a liquid heat-carrier medium of higher volume-specific heat capacity. The drying apparatus is divided, according to the invention, into, firstly, a vapor-heated drying section, where the entering vapors, which were previously heated in the gas-gas heat exchanger, serve as a drying medium while cooling and, secondly, a downstream drying section, where there is at least one heat register to provide additional heat to the drying apparatus. This heat register, while emitting heat on the heat side as a heating medium, condenses steam or cools a liquid heat carrier medium of higher volume-specific heat capacity, as a result of which, in addition to prior heating by vapor, there is drying heat supplied to the drying apparatus. The additional heat transfer device and the heat register arranged in the drying apparatus are connected to each other in a known manner and form a heating medium circuit.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single FIGURE shows a schematic block diagram of a drier unit according to the invention.

DETAILED DESCRIPTION OF THE PREFERRED EMBODIMENTS

Figure 1:
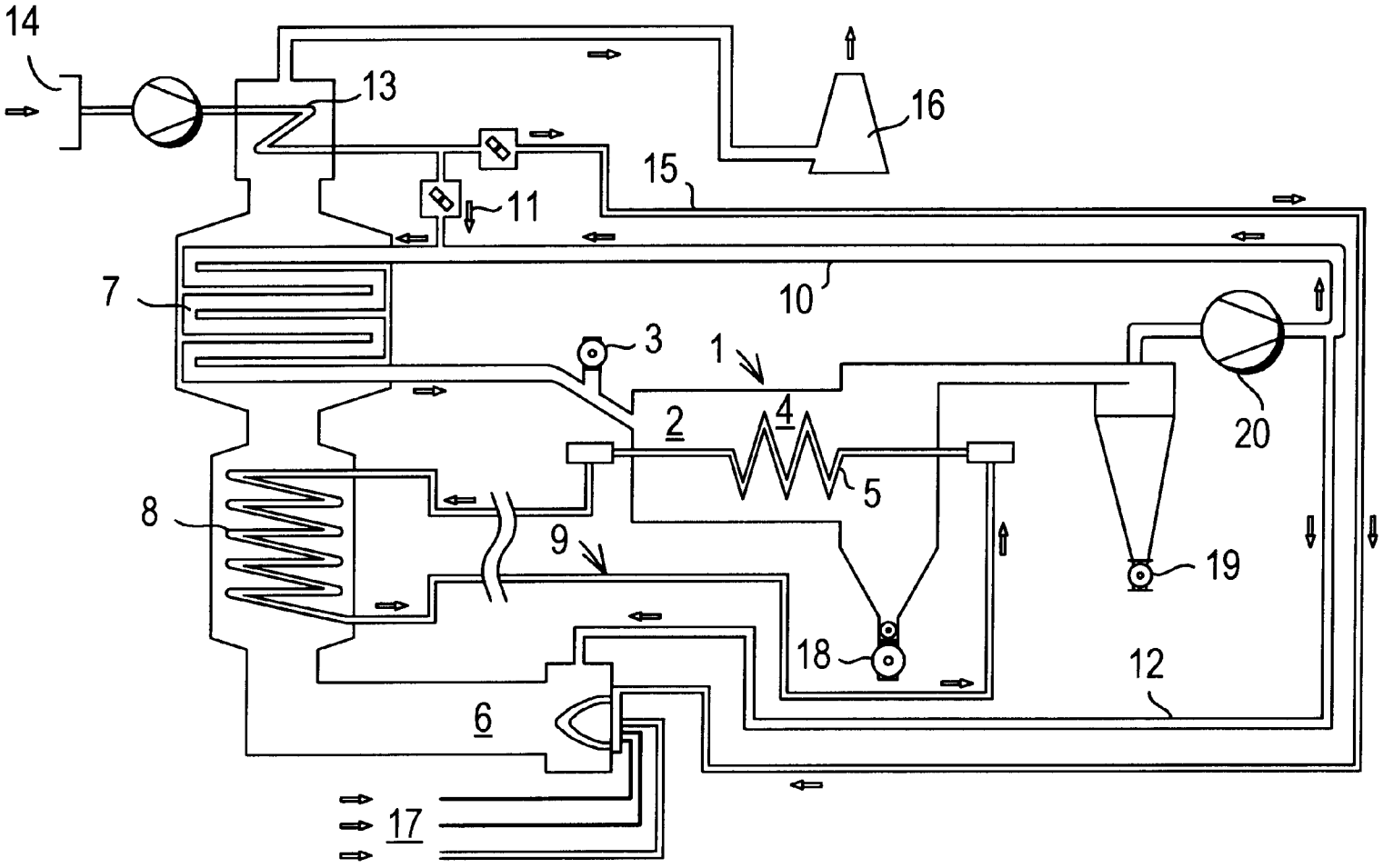

As the drawing shows, the drying apparatus 1, here a rotary drum, is divided into a first, vapor-heated drying section 2, which directly follows a damp materials feed or inlet 3, and a second drying section 4 following the first drying section 2 with additional heating by a heat register 5 inside the drying apparatus 1. The vapor heated drying section 2 may for example be a pre-drier, such as a flow tube drier, arranged in the vapor circuit upstream of the rotary drum.

There is also a vapor circuit which encompasses a gas-gas heat exchanger 7, the drying apparatus 1 and a vapor feedback or return 10.

An additional heat transfer device 8 is arranged in front of the gas-gas heat exchanger 7 in the flow direction of the incinerator exhaust gases coming from the combustion chamber 6. On the heat side, the heat transfer device 8 is subjected to the incinerator exhaust gases at combustion chamber temperature. However, the heat transfer device 8 is much less sensitive to these high heat-side temperatures than is the gas-gas heat exchanger 7, because the heat transfer device 8 is supplied on the cool side with a heat carrier medium that has a high volume-specific heat transfer capacity and therefore results in lower wall temperatures while requiring substantially lower cool-side flow cross-sections than a gas-gas heat exchanger. The heat transfer device 8 can therefore be constructed from steel tubes. The additional heat transfer device 8 is embodied as a steam producer or a thermal oil or pressurized water heater, which are components that have long been arranged after incinerators in a known and proven manner.

It is advantageous for the efficiency of the heat transfer device to be selected so that the incinerator exhaust leaves the heat transfer device 8 at a temperature of approximately 500° C. to a maximum of approximately 600° C. This ensures that temperature-related material problems no longer occur in the gas-gas heat exchanger 7, and also allows the gas-gas heat exchanger 7 to be embodied as a simple and economical steel sheet structure with a low heat storage mass in a manner long known and proven.

At the same time, the incinerator temperature, which is no longer limited by the thermal load capacity of the gas-gas heat exchanger 7, is optimally set to ensure extensive destruction of the polluting substances. Incineration temperatures from roughly 900° C. to roughly 950° C. are possible.

The heat extracted from the incinerator exhaust gas during the cooling of said gas in the heat transfer device 8 is fed via a widely known heating medium circuit 9 to the heat register arrangement 5 in the drying apparatus 1 arranged after the vapor-heated first drying section 2. There, where the vapors no longer have significant usable heat, this heat is made useful to the drier. The heating medium circuit 9 is designed for steam, pressurized water or thermal oil; known elements such as pumps, fittings and containers are not shown in the drawing.

If the additional heat transfer device 8 is a steam producer, the heat register arrangement 5 is designed as a condenser. If the additional heat transfer device 8 is a heater for thermal oil or pressurized water, the heat register arrangement 5 is designed as a heat exchanger. Such heat registers are widely and long known as heating elements inside the drying apparatuses of indirectly heated driers. The heat register arrangement 5 causes an intermediate warming of the drier, which, as is known, increases the drying rate in this region compared with pure vapor heating; i.e., the required standing time of the material in the drying apparatus drops. The drying apparatus 1 thus can be smaller in structure. In contrast to one-stage drying, drying with intermediate heating makes it possible to operate at lower temperatures, as is known, both in the vapor-heated first drying section 2 and in the second additionally heated drying section 4. This increases the efficiency of the drier and also reduces the temperature load on the additional heat transfer device 8 and the gas-gas heat exchanger 7. The careful drying of temperature-sensitive materials is thus possible.

In a further embodiment of the invention the vapor circuit includes means for supplying fresh air 11. In the vapor feedback 10 and a raw exhaust air conduit 12, which leads the surplus vapor from the drier to the combustion chamber 6 as secondary air, this measure reduces the danger of condensate formation and precipitation of vapor-volatile combustible substances on the tube walls, because it ensures that no pure steam with a condensation temperature of 100° C. is present. Rather, there is a steam-air mixture whose dew point temperature is under 100° C. As a result, the fire danger when the drier is turned on and off and during operational malfunctions with load loss is reduced. Furthermore, operationally conditioned fluctuations of the incineration temperature are compensated for by changes in the supply of fresh air to the vapor circuit, because changes in the fresh air supply directly influence the secondary air flow to the incinerator 6. Fuel supply lines 17 for gas, oil and/or combustion dust are provided for supplying fuel to the combustion chamber.

In contrast to previously known driers of this type, in a drier according to the invention, the gas-gas heat exchanger 7 transmits only a part of the required drying heat and, due to the previous cooling of the incinerator gases in the additional heat transfer device 8, is flowed to at lower heat-side temperatures of only approximately 500° C. to 600° C. However, the gas-gas heat exchanger 7 is flowed through in unchanged fashion on the cool side by the entire flow of the vapor circuit. This permits substantially lower heat side exit temperatures from the gas-gas heat exchanger 7 than in previously known driers of this type. Usually, an air preheater 13 is arranged after the gas-gas heat exchanger 7 in the flow direction of the incinerator exhaust gases and heats the air entering through the fresh air supply 14 to serve as combustion air 15 and fresh air 11 in the vapor circuit. After the air preheater 13, the exhaust air makes its way to the exhaust air chimney 16 at temperatures of only approximately 150° C., with a simultaneous incineration temperature of approximately 900° C.

The drying apparatus also includes a dry materials extractor 18 which extracts the dried materials from the rotary drum. Downstream of the drying apparatus 1 is a fine materials separator which separates out fine materials from the vapor circuit. A vapor ventilator 20 is provided downstream of the separator 19 and is in fluid communication with the vapor return 10 and the raw exhaust air conduit 12.

According to the invention, it is thus possible to destroy the toxic and odorous substances in the exhaust air by means of an incinerator-heated drier with considerable improvement of heat utilization and at higher incineration temperatures, compared with previously known driers of this type, while also increasing the operational reliability and useful life of the unit.

The invention is not limited by the embodiments described above which are presented as examples only but can be modified in various ways within the scope of protection defined by the appended patent claims.

I claim:

1. A drier for bulk goods with exhaust gas purification by thermal postcombustion, comprising:

a drying apparatus;

an incinerator arranged to indirectly heat the drying apparatus and having an exhaust gas flow;

at least one gas-gas heat exchanger arranged in the exhaust gas flow for heating vapor, the drying apparatus and the gas-gas heat exchanger being in fluid communication to form a vapor circuit;

an air preheater arranged in the exhaust gas flow downstream of the gas-gas heat exchanged; and an additional heating medium circuit including a heater arranged in the incinerator exhaust gas flow upstream of the gas-gas heat exchanger, and a heat register arranged in the drying apparatus and in fluid communication with the heater.

2. A drier as defined in claim 1, wherein the drying apparatus is divided into a first, vapor-heated drying section and a second drying line arranged downstream of the first drying section so as to be heated by the heat register.

3. A drier as defined in claim 1, wherein the heater is configured so that incinerator exhaust gas has a temperature as it leaves the heat transfer device that is approximately 500° C. to a maximum of approximately 600° C.

4. A drier as defined in claim 1, wherein the heater is a heat exchanger, and the heat register inside the drying apparatus is a heat exchanger.

5. A drier as defined in claim 1, wherein the heater is a steam producer, and the heat register inside the drying apparatus is a condenser.

6. A drier as defined in claim 1, wherein the air preheater is arranged to supply heated fresh air to the vapor circuit.

7. A drier as defined in claim 1, wherein the drying apparatus is a rotary drum, and further comprising a pre-drier arranged in the vapor circuit upstream of the rotary drum.

8. A drier as defined in claim 7, wherein the pre-drier is a flow tube drier.

9. A drier as defined in claim 1, and further comprising a pre-drier arranged in the vapor circuit upstream of the drying apparatus.

10. A drier as defined in claim 9, wherein the pre-drier is a flow tube drier.

* * * * *